US006016988A

United States Patent [19]

Meyer

[11] Patent Number: 6,016,988

[45] Date of Patent: Jan. 25, 2000

[54] METHOD OF AND APPARATUS FOR THE WINDING UP OF WEBS, ESPECIALLY SYNTHETIC RESIN FOIL WEBS

[75] Inventor: Helmut Meyer, Troisdorf, Germany

[73] Assignee: Reifenhauser GmbH & Co. Maschinenfabrik, Troisdorf, Germany

[21] Appl. No.: 09/139,259

[22] Filed: Aug. 25, 1998

[30] Foreign Application Priority Data

Sep. 3, 1997 [DE] Germany ..... 197 38 519

[51] Int. Cl.[7] ..... B65H 18/26; B65H 23/00

[52] U.S. Cl. ..... 242/534; 243/547; 243/548

[58] Field of Search ..... 242/547, 534, 242/541.4, 541.5, 541.6, 541.7, 548, 548.1

[56] References Cited

U.S. PATENT DOCUMENTS

| | | | |
|---|---|---|---|
| 3,237,877 | 3/1966 | Printz et al. | 242/541.6 |
| 4,171,107 | 10/1979 | Kayser et al. | 242/541.6 |
| 4,343,440 | 8/1982 | Engl | 242/547 |
| 4,491,283 | 1/1985 | Pav | 242/547 |
| 4,850,545 | 7/1989 | Ballard et al. | 242/547 |
| 5,653,400 | 8/1997 | Narita et al. | 242/547 |
| 5,806,783 | 9/1998 | Turunen | 242/547 |

*Primary Examiner*—John M. Jillions
*Attorney, Agent, or Firm*—Herbert Dubno

[57] ABSTRACT

Instead of long stroke piston and cylinder arrangements for actuating the counterroller of a foil-winding system, a rotary field servomotor can form a drive unit for the counterroller and can be angularly displaceable with the angular displacement being controlled by a pneumatic piston which exerts the pressure required between the contact roller and the roll.

8 Claims, 4 Drawing Sheets

FIG. 1
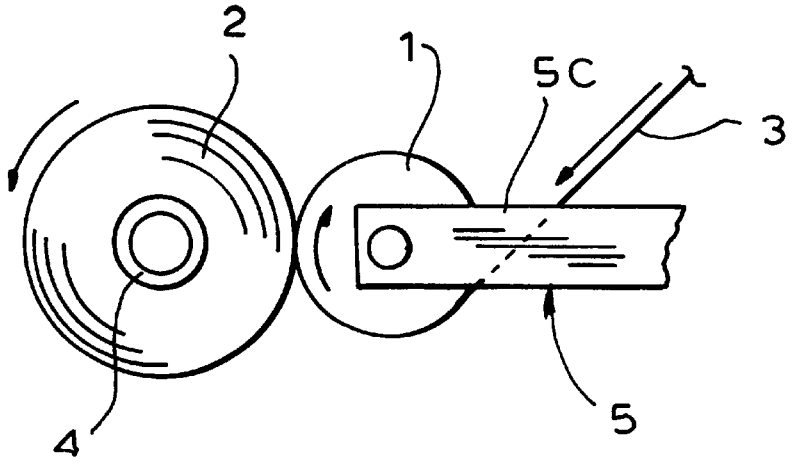
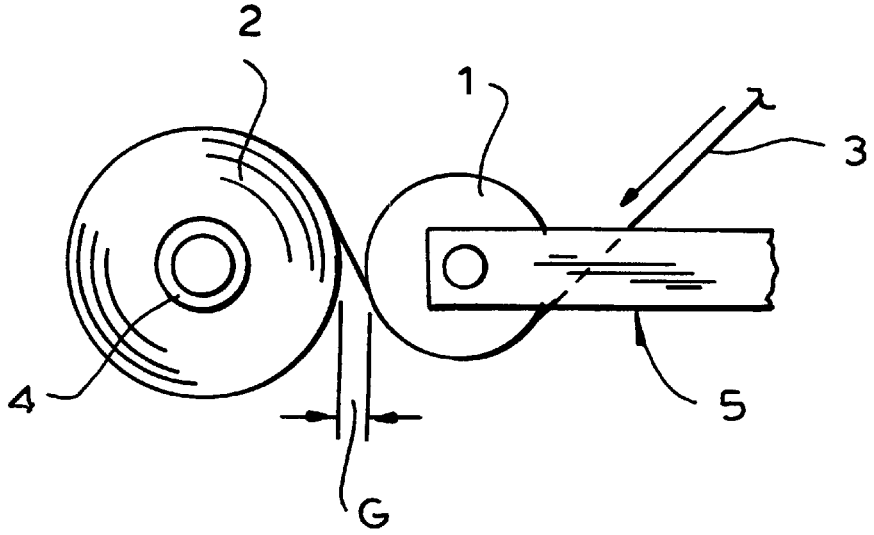
FIG. 2

METHOD OF AND APPARATUS FOR THE WINDING UP OF WEBS, ESPECIALLY SYNTHETIC RESIN FOIL WEBS

FIELD OF THE INVENTION

My present invention relates to a method of winding up a web, especially a flattened foil web of synthetic resin material (e.g. a flattened blown-foil web) wherein the web is wound on a winding tube, core or sleeve and a counterroller is juxtaposed with the roll during the winding process. The counterroller can be a contact roller, which applies a certain pressure against the roll as the web is wound thereon and the diameter progressively increases, or another roller juxtaposed with the roll. The invention also relates to an apparatus for carrying out the method of the invention and, therefore, to an apparatus for winding up a roll of a synthetic resin web.

BACKGROUND OF THE INVENTION

Winding systems in which a core, sleeve or tube serves to wind up a roll or coil of a web, especially a synthetic resin web, are of course known. In the framework of the present invention, the term "contact winding" will be used to refer to a winding system in which a contact roller directly bears upon the roll and exercises a predetermined contact pressure thereon so that, as the web is wound on the roll, a certain flattening pressure is applied to the foil.

The contact roller is, therefore a counterroller which is juxtaposed with the roll. The invention recognizes a rolling system in which the counterroller is spaced somewhat from the roll by a gap in so-called "gap rolling". In that case, the counterroller may be in contact with the web but is spaced from the roll by a predetermined gap width, the web being fed to the roll through the gap.

Of course such winding systems can include other auxiliary equipment or devices which may not be described in greater detail hereinafter but are customarily provided as winding systems are present. For example, the system can include a device for feeding the winding tubes to the apparatus, guide rollers or the like for guiding the web to the roll, transverse separating means for cutting the web when a wound roll is full and before a free end of the web is to be delivered to a new winding tube, and, of course, means for transporting away the completed roll.

It is not uncommon in such winding systems to mount the counterroller on a slide means, i.e. to journal the counterroller in bearings supported by a pair of slides on opposite ends of the counterroller. The slides may be moved by two parallel slider pneumatic cylinders. For these cylinders to provide the pressing force they must be capable of following the winding operation over the full diameter of the finished roll. In that case, the cylinders must have a comparatively large stroke. Such cylinders are extremely expensive and, because of limited availability and problems of accessibility of the slides and cylinder arrangements, it has been difficult in the past to realize a desired constant pressing force of the contact roller against the roll in the process of being wound, at least over the entire winding process.

In fact, when there are irregularities in the winding process and a tendency for the roll to develop irregular contours or portions which deviate from the cylindrical, the guidance and maintenance of a constant pressing force may prove to be difficult and the quality of the foil may be adversely affected.

Similar problems arise when it is essential to maintain a constant gap width in the case of gap winding, i.e. where the counterroller is to be spaced at a precise distance from the roll being wound.

OBJECTS OF THE INVENTION

It is the principal object of the present invention, therefore, to provide a method of winding a roll, especially of a flattened synthetic resin foil, utilizing either the contact rolling process or the gap rolling process, such that the rolling is more reliable and precise and problems in the positioning of the counterroller can be avoided.

It is also an object of the invention to provide a method of this type whereby more precise contact pressure can be maintained in spite of irregularities in the winding operation otherwise.

Another object of the invention is to provide a method of winding using the gap winding principle whereby the gap is maintained substantially constant with considerable accuracy.

Still a further object of this invention is to provide an apparatus for the winding of rolls of a web, especially a synthetic resin web, which is characterized by simplicity, reliability and low capital cost, and yet which is free from the drawbacks of earlier systems.

SUMMARY OF THE INVENTION

These objects and others which will become apparent hereinafter are attained, in accordance with the invention, in a system which eliminates the need for a long-stroke hydropneumatic or piston-and-cylinder arrangement to accommodate a large-roll diameter and which is otherwise free from the drawbacks of earlier systems and which utilize a rotary field or three-phase servomotor to drive the slides of the counterroller through a transmission and wherein the transmission and the servomotor form a unit rotatable relative to a housing, a short-stroke cylinder being connected to this unit so that upon application of force from the cylinder to the unit, the necessary force for pressing the counterroller against the roll being wound can be generated or an action of the short-stroke cylinder can be used for the accurate and final position of the counterroller.

More particularly, the slides are driven by a drive unit which itself is rotatable and includes a three-phase servomotor and depending upon the roll diameter, this servomotor is driven to position the counterroller relative to the roll being wound. Depending upon the foil diameter, the rotary position of the drive unit has a respective setpoint position.

The pressing force of the contact roller on the foil roll is generated by a predetermined cylinder pressure in a short-stroke cylinder which is connected to the rotatable drive unit. Upon a shifting of the slide from its setpoint position, the drive unit is rotated and as a consequence the piston position in the short-stroke cylinder is varied. Depending upon the rotation of the drive unit, the slides are restored with the servomotor into the setpoint position and a predetermined piston setpoint position is reestablished in the short-stroke cylinder.

The invention thus comprises a method of rolling up a web with the following steps:

- winding a web onto a winding tube to form a roll of progressively increasing diameter;
- juxtaposing with the roll during the winding of the web a counterroller;
- displacing the counterroller to follow the progressive increase in the diameter of the roll by:
  - detecting the diameter of the roll, controlling a rotary field servomotor driving a rotary mechanism coupled with slides carrying the counterroller in response to the detected diameter to position the counterroller at a setpoint position, the rotary field servomotor and a rotary mechanism forming a unit rotatable on a housing, and then adjusting a position of the counterroller by pressurizing a short-stroke cylinder operatively connected to the unit for angularly displacing same.

Advantageously, the counterroller is a contact roller pressed against the roll during the winding thereof, a pressing force of the contact roller against the roll being generated by a predetermined pressurization of the short-stroke cylinder, the method further comprising the steps of:

varying a position of a piston in the short-stroke cylinder upon a shifting of the slides from the setpoint position of the unit;

driving the slides with the rotary field servomotor by an amount corresponding to the rotation of the unit to restore the slides to the setpoint position and establish a piston setpoint position in the short-stroke cylinder.

In apparatus aspects, the apparatus can comprise:

means for winding a web onto a winding tube to form a roll of progressively increasing diameter;

a counterroller juxtaposed with the roll during the winding of the web;

slide means for supporting the counterroller and movable toward and away from the roll;

means for detecting a progressive increase in the diameter of the roll;

a rotary field servomotor driving a rotary mechanism coupled with the slide means and responsive to the means for detecting to position the counterroller at a setpoint position, the rotary field servomotor and a rotary mechanism forming a unit rotatable on a housing; and a short-stroke cylinder operatively connected to the unit for angularly displacing same to adjust a position of the counterroller.

Preferably the counterroller is a contact roller bearing on the roll with a predetermined contact pressure, the unit being rotated by the short-stroke cylinder to generate the contact pressure and the short-stroke cylinder receiving a predetermined cylinder pressure, the apparatus further comprising a position-measuring device for measuring a displacement of the unit from the setpoint position for operating the rotary field servomotor to restore a piston of the short-stroke cylinder to a piston setpoint position.

According to the method of the invention, the rolling up process is preferably a contact roller in which the contact roller is the aforementioned counterroller and is urged with a predetermined pressure against the winding tube or the foil turns thereon. If gap winding is to be used, the counterroller is held at a predetermined distance from the winding tube or the foil turns thereon without coming into contact with those turns.

Preferably the slides carrying the counterroller are continuously adjusted relative to the roll as it is wound up by the rotary field or three-phase servomotor which is coupled to the slide via a suitable transmission. In other words the servomotor drives the slides so that the counterroller can follow the winding process and maintain a constant pressure in the case of contact winding between the counterroller and the roll or a constant gap width in the case of gap winding. In a latter case, the short-stroke piston need not be used although it can be employed to provide a correction of the position of the counterroller if desired. However in the former case, i.e. when the counterroller is to exert a pressure against the roll being wound, the short-stroke cylinder serves to provide, maintain and control the contact pressure. The pneumatic cylinder in the case of gap winding can be fully extended.

In terms of the apparatus, the rotary field servomotor is connected by a transmission to the slides and the servomotor is operated based upon the measurement of the roll diameter for each roll diameter. In turn, the angular position of the servomotor and its transmission has a setpoint position relative to the machine frame or housing and this angularly displaceable drive unit is displaced through a fraction of a revolution by the short-stroke cylinder to apply the pressing force. A predetermined cylinder pressure is thereby developed in the short-stroke cylinder.

Since a position-measuring unit is provided for determining a shift of the slide from their setpoint positions, that measuring unit can measure the angular displacement of the drive unit and depending upon the determined angular displacement, the slides can be reset by means of the rotary field servomotor into the setpoint position.

At standstill of the rotary field servomotor the drive unit, i.e. the rotary field servomotor and its transmission, form an angularly stiff unit which is journaled in the machine frame or housing. The servomotor is capable of providing a high standstill torque. The short-stroke cylinder, which is preferably configured as a pneumatic cylinder, forms with its piston rod a torque generator for the rotatable drive unit and thus can establish the predetermined pressing force of the contact roller against the roll being wound during contact rolling. For this purpose the predetermined cylinder pressure, i.e. air pressure, is established in the cylinder for that pressing force.

Preferably the cylinder pressure is not externally altered during the winding process.

When required, a slight cylinder pressure correction can be made in the case of a rotation of the drive unit from its setpoint position resulting in a shifting of the cylinder piston. As a consequence the cylinder pressure is usually held constant and/or the cylinder pressure correction can be automatically effected by a proportional valve.

The rotation of the drive unit in the case of an undesired shift of the slides from their setpoint positions, for example in the case of a variation of the roll diameter at different locations about the periphery of the roll, i.e. in the case of a noncylindrical or nonround condition, can result in an actuation of the piston rod. Since the cylinder pressure is held constant preferably via the proportional valve, a measurement of the displacement can serve as a basis for rotation of the output shaft of the rotary field servomotor to restore the piston or piston rod into the setpoint position of the piston.

The position of the rotary field servomotor can be given by a motor revolution counter which can produce a multiplicity of pulses per motor revolution. In this manner the position of the slides can be given with great precision. Advantageously, a reference sensor is provided on the machine frame or housing to detect the starting position of the slides. This reference sensor serves in the sense of the position control of the invention as a zero point detection device. Preferably the drive unit has a first lever arm connected to the piston rods of the pneumatic cylinder while a second lever arm is connected to a position-measuring unit.

The unit is based upon the fact that by combining the rotary field servomotor with a torque supporting short-stroke cylinder, the contact roller can be positioned precisely and a relatively high pressing force can be generated with a minimum cylinder stroke and with a cylinder having comparatively low friction. In practice it is found that the stroke of the cylinder need only be 60 to 100 mm. This system can compare with conventional arrangements using two cylinders with much greater strokes and which are incapable of maintaining similarly reliable and precise positions of the contact roller. The system of the invention also has been found to be advantageous in maintaining a predetermined gap width for gap winding.

The invention makes use of a rotary field servomotor which is comparatively simple and nevertheless can maintain a high standstill torque. The maximum displacement speed of the slide should not be greater than 0.05 m/s which is particularly suitable for such a motor.

BRIEF DESCRIPTION OF THE DRAWING

The above and other objects, features, and advantages will become more readily apparent from the following description, reference being made to the accompanying drawing in which:

FIG. 1 is a diagram of a contact winding system in accordance with the invention;

FIG. 2 is a diagram of a gap winding system;

SPECIFIC DESCRIPTION

Figure 3:
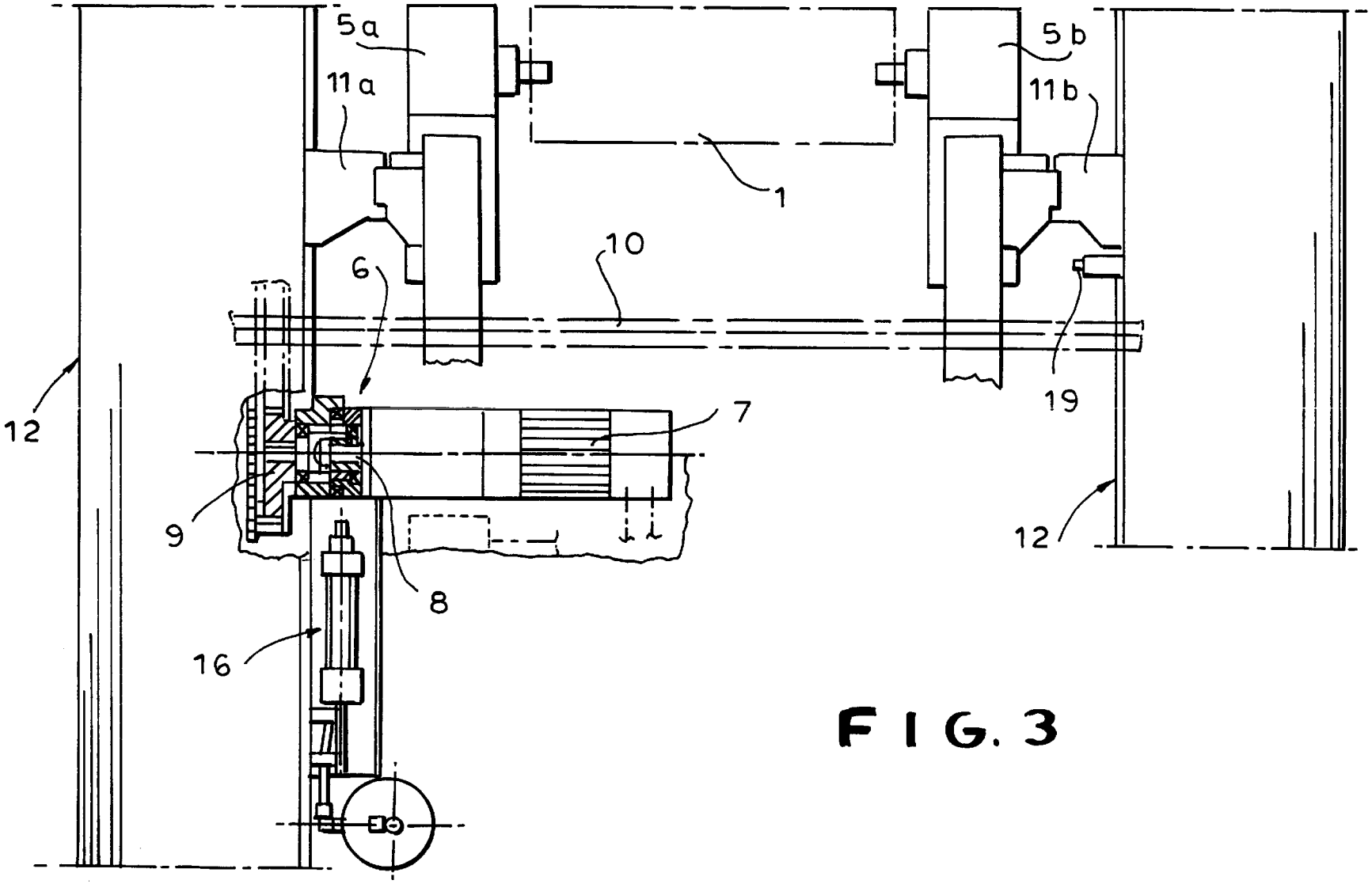
FIG. 3 is a plan view of an apparatus according to the invention, partly broken away.

FIGS. 1 and 2 show possible arrangements of a counterroller 1 and a foil roll 2 in the winding up of a web of synthetic resin foil, the web being represented at 3. In FIG. 1, the counterroller 1 is a contact roller and the process illustrated is the contact rolling process. The foil web 3 passes around the contact roller 1 and into the nip between this roller and the roll 2 of the foil as it is wound up on the winding tube or sleeve 4. The contact roller 1 is mounted in slides 5 (only one of which is visible in FIG. 1 but represents two such slides on opposite sides of the contact roller 1). The slides 5 are displaceable in the direction represented by the arrow 5*c* to apply the pressing force between the contact roller 1 and the roll 2. In FIG. 2, the counterroller 1 is held by the slides 5 at a predetermined distance from the roll 2 to define a gap G therebetween. This is a gap winding system and both the gap winding system and the contact winding system can use the mechanisms shown in FIGS. 3–5 in the manner described.

From FIG. 3 it will be apparent that the slides 5 are driven by a drive unit 6 which itself is angularly displaceable in a machine frame or housing. The drive unit 6 comprises a rotary field servomotor 7 which has an output shaft 8 connected to a pinion 9. The pinion 9 drives, preferably for an intermediate transmission not shown, the slide shaft 10. The slide shaft, in turn, has pinions in the region of the slide parts 5*a* and 5*b* which engage racks connected to these slide parts for displacing the slides 5. The contact roller 1 is supported between the slide parts 5*a* and 5*b* as has been shown in dot dash lines in FIG. 3.

Figure 6:
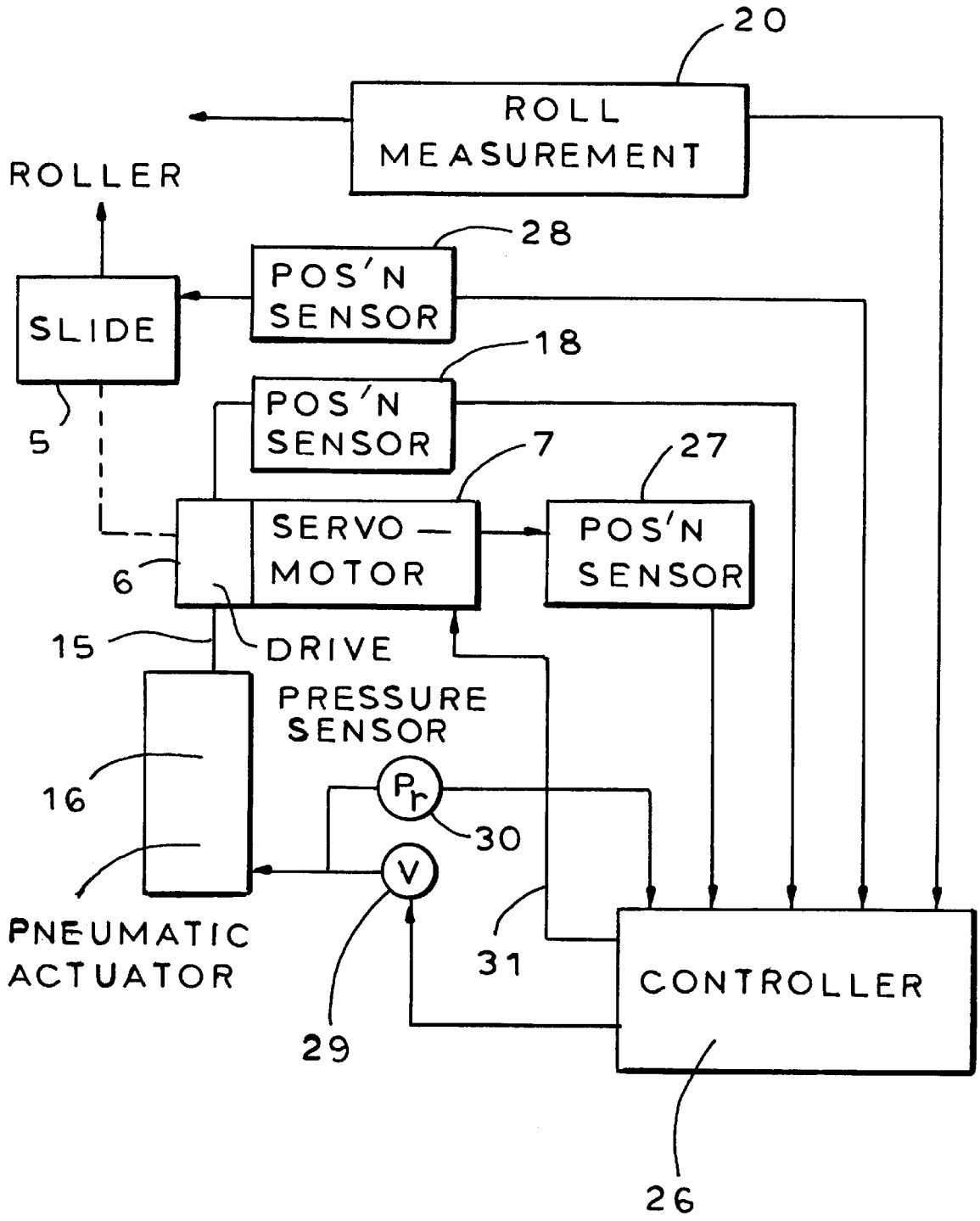
FIG. 6 is a diagram of a control system for the apparatus.

In the region of the foil turns, a measuring device is provided which has not been shown in FIG. 3 but is found at 20 in FIG. 6 to measure the diameter of the roll 2.

The slide system 5 is displaced by operation of the rotary field servomotor 7 as has been described. The slide parts 5*a* and 5*b* can be guided in guides 11*a* and 11*b* in the machine frame or housing 12.

Figure 4:
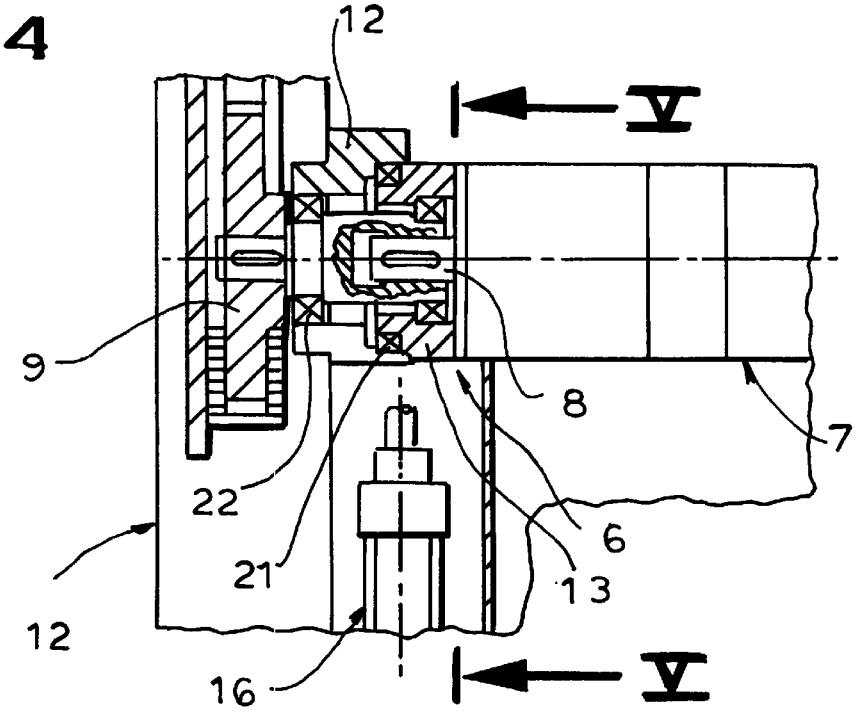
FIG. 4 is a detail of a portion of the system of FIG. 3 drawn to a larger scale.

FIG. 4 shows that the drive unit 6 can include a planetary gear transmission having a high torque even at standstill of the drive unit. The drive unit 6 is composed of the rotary field servomotor 7, its output shaft 8, the planetary gear transmission, the pinion 9 and the flange 13 which forms an angularly stiff system journaled in bearings 21 and 22 in the machine frame or housing 12.

The angular displacement drive unit 6 (FIG. 5) preferably has a lever arm 14 connected pivotally to a piston rod 15 of a short stroke cylinder 16 preferably a pneumatic cylinder. A predetermined cylinder pressure or air pressure can be established in the pneumatic cylinder 16. The pneumatic cylinder 16, with its piston rod 15 simultaneously forms a torque brace in the unit 6. In other words a rotation of the drive unit 6 is resisted by the short stroke cylinder 16 and the latter therefore can provide a pressing force of the contact roller 1 against the foil roll 2. The pressing force of the contact roller is thus a function of the cylinder pressure or air pressure in the short stroke cylinder 16. At the beginning of the winding process, especially in the case of contact winding, the slide 5 is prepositioned by the rotary field servomotor 7, preferably at a distance of 10 mm from the winding tube 4. Then cylinder pressure is generated in the short stroke cylinder 16 to rotate the unit 6 and displace the slide 5 further toward the winding tube so that the contact roller 1 presses with the requisite contact pressure against the roll.

Figure 5:
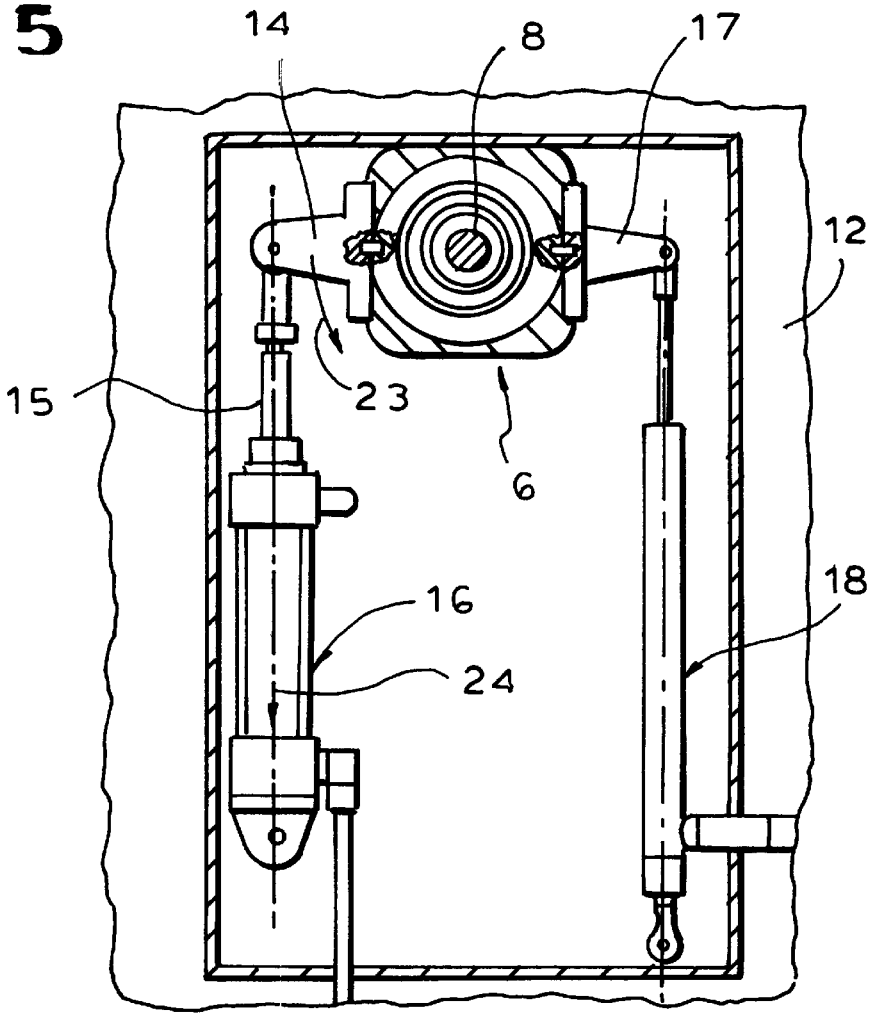
FIG. 5 is a section taken along the line V—V of FIG. 4.

If the contact roller 1 or the slide 5 is shifted, e.g. because of irregularities systematically arising during the winding process, the pinion 9 is actuated for the shaft 10 and the drive unit 6 is correspondingly rotated. The lever arm 14 is shifted for example in the direction of the arrow 23 shown in FIG. 5 and the piston rod 15 correspondingly pushed into the short stroke cylinder 16 (arrow 24). The cylinder pressure or air pressure in the cylinder 16 is held constant, preferably with the aid of a proportional valve. The shift in the slide 5 from its setpoint position is detected by the measuring unit 18 which is coupled to the other lever 17 of the drive unit 6. In the embodiment of FIG. 5 the measuring unit 18 is a linear potentiometer.

Depending upon the measured rotation of the unit 6, the servomotor 7 is actuated to restore the drive unit 6 to its setpoint position. The drive unit 6 or the lever arm 14 are returned to their original positions which preferably corresponds to a horizontal orientation of the lever arms 14 and 17 as shown in FIG. 5 and wherein the contact roller 1 is held with a constant pressure against the coil 2.

When gap winding is used, the slide 5 is brought into a setpoint position with a constant gap G between the coil 2 and the roller 1. The short stroke cylinder 16 in the gap winding state need not have any function and preferably the piston rod 15 of the cylinder 16 is fully extended in this position.

FIG. 3 shows a reference sensor 19 to detect the starting position and located on the machine frame 12, in the region of the slide guide 11*b*. The reference sensor serves for position control of the slide and to establish the zero point setting. One or more additional sensors can be provided at the slide guides 11*a* and 11*b*.

From FIG. 6 it will be apparent that a controller 26 can be provided to receive the roll diameter measurement at 20, the servomotor position via the pulse generator 27, an input from a position sensor 18 for the angular position of the drive unit 6 relative to the housing, and input from a position sensor 28 representing the slide position is detected from any other position sensor along the slide guides. The controller 26 can actuate the valve 29 supplying the compressed air to the pneumatic actuator 10 and a feedback from a pressure sensor 30 can be provided to the controller 26. The operational sequence has previously been described and the input to the servomotor 6 is represented at 31.

I claim:

1. A method of rolling up a web, comprising the steps of:

winding a web onto a winding tube to form a roll of progressively increasing diameter;

juxtaposing with said roll during the winding of said web a counterroller;

displacing said counterroller to follow the progressive increase in the diameter of said roll by:

detecting the diameter of said roll, controlling a rotary field servomotor driving a rotary mechanism coupled with slides carrying said counterroller in response to the detected diameter to position said counterroller at a setpoint position, the rotary field servomotor and a rotary mechanism forming a unit rotatable on a housing, and then adjusting a position of said counterroller by pressurizing a short-stroke cylinder operatively connected to said unit for angularly displacing same.

2. The method defined in claim 1 wherein said counterroller is a contact roller pressed against said roll during the winding thereof, a pressing force of said contact roller against said roll being generated by a predetermined pressurization of said short-stroke cylinder, said method further comprising the steps of:

varying a position of a piston in said short-stroke cylinder upon a shifting of said slides from said setpoint position of said unit;

driving said slides with said rotary field servomotor by an amount corresponding to the rotation of said unit to restore said slides to said setpoint position and establish a piston setpoint position in said short-stroke cylinder.

3. An apparatus for rolling up a web, comprising:

means for winding a web onto a winding tube to form a roll of progressively increasing diameter;

a counterroller juxtaposed with said roll during the winding of said web;

slide means for supporting said counterroller and movable toward and away from said roll;

means for detecting a progressive increase in the diameter of said roll;

a rotary field servomotor driving a rotary mechanism coupled with said slide means and responsive to said means for detecting to position said counterroller at a setpoint position, the rotary field servomotor and a rotary mechanism forming a unit rotatable on a housing; and a short-stroke cylinder operatively connected to said unit for angularly displacing same to adjust a position of said counterroller.

4. The apparatus defined in claim 3 wherein said counterroller is a contact roller bearing on said roll with a predetermined contact pressure, said unit being rotated by said short-stroke cylinder to generate said contact pressure and said short-stroke cylinder receiving a predetermined cylinder pressure, said apparatus further comprising a position-measuring device for measuring a displacement of said unit from said setpoint position for operating said rotary field servomotor to restore a piston of said short-stroke cylinder to a piston setpoint position.

5. The apparatus defined in claim 4 wherein said rotary field servomotor is provided with a motor-revolution counter as a position sensor for said slide means.

6. The apparatus defined in claim 4 wherein said housing has a reference sensor for monitoring a position of said slide means.

7. The apparatus defined in claim 4 wherein said unit has a first lever arm connected to a piston rod of said piston and a second lever arm connected to a position-measuring device.

8. The apparatus defined in claim 4 wherein said short-stroke cylinder is a pneumatic cylinder.

* * * * *